United States Patent [19]

Blake, deceased

[11] 4,029,509

[45] June 14, 1977

[54] POSITIVE PROCESS USING A LOW COATING WEIGHT SILVER HALIDE

[75] Inventor: Ralph Kingsley Blake, deceased, late of Union County, N.J., by June Arlene Blake, executrix

[73] Assignee: E. I. Du Pont de Nemours and Company, Wilmington, Del.

[22] Filed: Nov. 17, 1975

[21] Appl. No.: 632,729

[52] U.S. Cl. ..... 96/60 R; 96/64; 96/67; 96/68

[51] Int. Cl.[2] ..... G03C 5/32; G03C 5/24; G03C 1/76

[58] Field of Search ..... 96/64, 67, 68, 60 R

[56] References Cited

UNITED STATES PATENTS

| | | | |
|---|---|---|---|
| 2,322,001 | 6/1943 | Ehrenfried | 96/60 R |
| 2,856,284 | 10/1958 | Hamm | 96/36.3 |
| 2,875,052 | 2/1959 | Weyde | 96/68 |
| 3,178,282 | 4/1965 | Luckey et al. | 96/64 |
| 3,501,298 | 3/1970 | Crawford | 96/67 |
| 3,737,317 | 6/1973 | Nicholas et al. | 96/68 |
| 3,933,496 | 1/1976 | Kolev et al. | 96/60 |

*Primary Examiner*—Mary F. Kelley

[57] ABSTRACT

A process for obtaining camera speed direct positive images which employs a photographic element comprising a film support, a layer of photosensitive silver halide, and a layer containing a colorant (e.g. colloidal silver). The silver halide layer is first imagewise exposed, and the latent image developed in the presence of a compound capable of producing sulfide ions e.g. thiourea, and then the photographic element is immersed in a chemical bleach which removes the silver image generated in the silver halide layer and removes the colorant in the areas corresponding to the exposed areas of the silver halide layer, leaving a direct positive image in those areas of the colorant-containing layer which are directly under the unexposed nonimage areas of the silver halide layer.

8 Claims, 4 Drawing Figures

POSITIVE PROCESS USING A LOW COATING WEIGHT SILVER HALIDE

BACKGROUND OF THE INVENTION

1. Field of the Invention

This invention relates to a process for preparing high quality, camera speed direct positive images using a novel photographic imaging system which employs low coating weight silver halide elements. These elements can be used to advantage in place of any of the conventional direct positive elements. Because of the unique advantage of this novel system, the elements of this invention are faster and have better image quality than the prior art.

2. Description of the Prior Art

The use of non-photosensitive layers and materials in conjunction with photosensitive elements is well-known. Colorants, for example, are used to enhance or tone with the image formed in the photosensitive layers. Colorant layers are also used as anti-halation layers for the photosensitive layer and the like. Schneider in U.S. Pat. No. 1,971,430 teaches the use of colloidal silver in a binding agent designed for use as an anti-halation layer for a silver halide element. The use of colloidal silver in color film elements is also known from Mannes et al. U.S. 2,143,787 and the others. Shuman in Defensive Publication T900,010, published 7/18/72 describes how blue colloidal silver with a very small particle size can be changed to the yellow form by contacting with halide ions. According to T900,010 this process may be accomplished imagewise by contacting the blue colloidal silver layer with an exposed and developed silver halide image. Thus, the image results in the change of color from blue to yellow in the area corresponding to the developed silver halide image. This prior art does not teach, however, imagewise chemically bleaching a colorant layer. in conjunction with a photosensitive developable or developed silver halide layer to produce camera speed, direct positive high quality images therefrom. British Pat. No. 1,380,259 relates to high density silver images formed as a sound track for a 3-color negative process and to a method for retaining this metallic silver duurig the dye bleaching process. Final image amplification is not taught nor is the concept of that patent related to the novel elements and process described herein. In yet another system, the applicant has taught in U.S. Pat. No. 3,413,122 that high density images can be formed using low covering power high sensitivity silver halide layers in conjunction with high covering power low sensitivity silver halide layers. That patent does not teach, however, imagewise chemically bleaching a colorant layer in conjunction with a photosensitive layer to produce high speed, high qualityy, direct positive images therefrom.

SUMMARY OF THE INVENTION

It is an object of this invention to provide a novel, camera speed, direct positive, silver halide, photographic imaging system. A further object is to provide a novel, photographic imaging system having high speed, high covering power and improved image quality. A still further object is to provide said photographic imaging system using an extremely low silver halide coating weight element. These and other objects are achieved with a photosensitive element comprising a support, at least one layer containing a chemically bleachable colorant and at least one photosensitive silver halide layer associated therewith, by a process comprising:

1. imagewise exposing said photosensitive silver halide layer to actinic radiation,
2. developing an image in said silver halide layer,
3. no sooner than step (2), treating said element with a compound capable of generating sulfide ions under the conditions of treatment, and
4. chemically bleaching said colorant layer imagewise, whereby the image in the silver halide layer and the areas of the colorant layer which are under the image in the silver halide layer are bleached, leaving an image in the areas of the colorant layer which are under the nonimage (e.g., unexposed) areas of the silver halide layer.

DESCRIPTION OF THE PREFERRED EMBODIMENTS

Figure 1:
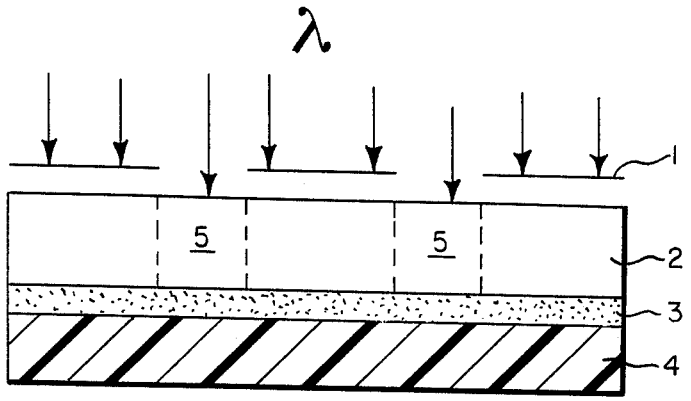
FIG. 1 is a cross-section of an element of this invention during imagewise exposure.
Figure 2:
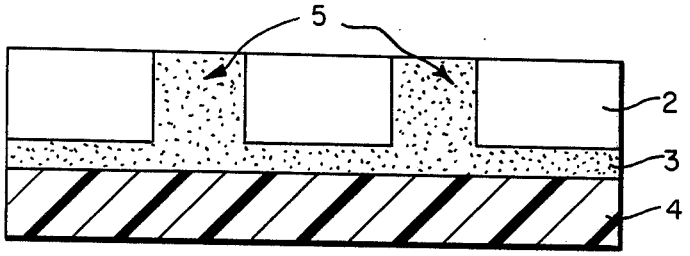
FIG. 2 shows the element of FIG. 1 after conventional development of the image in the photosensitive silver halide layer.
Figure 3:
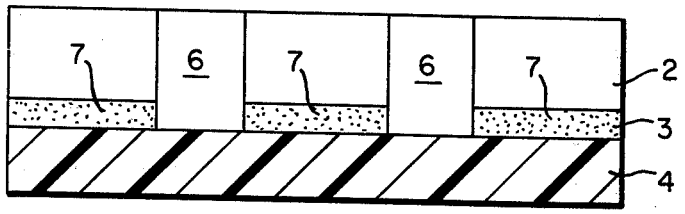
FIG. 3 shows the element of FIG. 2 after imagewise bleachhing has occurred.
Figure 4:
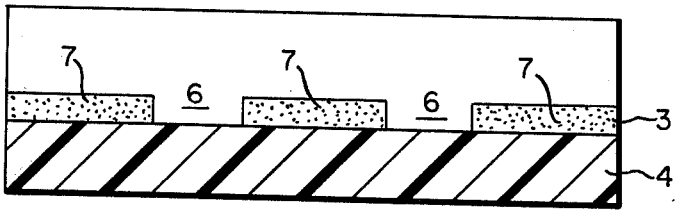
FIG. 4 after fixing to produce a final image with a clear background.

The drawings attached hereto demonstrate a particularly preferred embodiment of this invention. FIG. 1 shows the preferred element being given an exposure through an suitable mask 1, wherein 2 is a low coating weight silver halide layer, 3 is the inorganic colorant or opacifier layer (preferably colloidal silver), 4 the support, and exposed areas 5 containing the latent image formed within the silver halide layer by said exposure. FIG. 2 shows the same element after contact with a suitable silver halide developing agent additionally containing a compound capable of producing sulfide ions which can migrate through the unexposed regions of the silver halide layer and render nonbleachable those portions of layer 3. In this drawing, the latent image in areas 5 has now been converted to darkened relatively low covering power developed silver. FIG. 3 shows the element after chemical bleaching has occurred, and the areas 6 of layers 2 and 3, have been bleached. The areas labeled 7, which are directly under the unexposed silver halide layer, remain as the image. FIG. 4 shows the finished element after fixing has occurred, and the undeveloped silver halide in the silver halide layer above areas 7 and any regenerated silver salt in areas 6 have been removed, leaving the polymer or colloid binder of the layers. The final image is a direct positive of the original mask 1. This novel element permits use of a lower coating weight silver halide element, since the high density final image results from the high covering power, high tinctorial, colorant or opacifier layer 3. Thus, a camera speed, direct positive element is achieved using a low coating weight silver halide film. This element has excellent density, gradient and image quality. The discovery that the colorant layers, conventionally used in the prior art as antihalation layers and the like, would behave as image forming layers was entirely unexpected and is only achieved when the novel process steps of this invention are practiced. The prior art, when using colorant layers similar to those taught by this invention, exposed, developed and fixed the silver halide portion of the invention and subsequently bleached away the entire colorant layer. Since the prior art in this area was not concerned with formig direct positive images utilizing the non-photosensitive inorganic colorant layer, the colorant layers of the prior art were designed to exhibit low optical density in and of themselves and were often permeable to light (e.g. filter layers and the like).

The particularly preferred element as shown in the drawings includes a support 4 which preferably is any of the conventional silver halide supports, a colorant or opacifier layer 3, preferably comprising colloidal silver dispersed iin a gelatino binder, and the low coating weight silver halide layer 2. A preferred process of this invention involves the following steps:

a. imagewise exposure of the silver halide layer (2) — FIG. 1.

b. development to convert the latent image 5 into a silver image in layer 2 using a conventional silver halide developer including a compound which yields sulfide ions — FIG. 2.

c. oxidative bleaching of the colloidal silver 7 to a salt or complex in the regions corresponding to the exposed silver halide leaving substantially uneffected the colloidal silver under the nonimaged areas 7 — FIG. 3.

d. removal of the undeveloped silver halide 8, and any bleach generated silver salt, by conventional fixing leaving a high density direct positive remaining on the support — FIG. 4.

Alternatively, one may eliminate the sulfur containing compound in the developer and utilize a special bleach/fix combination. In this case, an extremely high contrast positive image results. Naturally, in this case, the bleach composition must be chosen to be compatible with the fixing solution. I have found that an iron chelate/thiosulfate, bleach/thiocyanate fix composition is particularly efficacious here. Other "blix" solutions containing large amounts of iodide will also produce this result. However, a compound which will generate sulfide ions in the aqueous developer is preferred. Then, conventional bleach and fix baths may be used separately or a mixed bleach/fix also used. By interposing the oxidative bleaching step (c) between the silver halide development and fixing steps (b) and (d) one is able to bleach imagewise an otherwise non-photosensitive layer. This fact is completely surprising and is not taught in the prior art. The novel process of this invention is not completely understood. Possibly, this phenomena may be explained by theorizing that the sulfide ion forms silver sulfide at the interface of the colloidal silver layer and the silver halide layer. The sulfide in the developing solution reacts with the silver formed in the imaged areas and thus none is available to form insoluble sulfide in the colloidal silver layer. Since no silver is available as such in the unexposed areas, the sulfide ion is free to migrate through the layer to the surface of the colloidal silver. As previously mentioned, however, this phenomenon is poorly understood. When colorants other than silver are used, they must be rendered resistant to bleach by sulfide ions in order to work within this process. The process of the invention may be used to produce extremely high contrast images, especially useful when exposure is through a halftone screen, producing extremely sharp, dense halftone positive dots.

DETAILED DESCRIPTION OF THE INVENTION

In practicing this invention, one may use a number of colorants or opacifying agents for the non-photosensitive layer described above and shown in the drawings. We prefer to use colloidal silver made according to any of the teachings of the prior art. Firestine et al. teaches, in German Pat. No. 1,234,031, for example, a method for making blue colloidal silver dispersed in a gelatino binder. Other procedures can be found in Hertz, U.S. Pat. 2,688,601; Peckmann U.S. Pat. No. 2,921,914; McGudern U.S. Pat. No. 3,392,021; Schaller U.S. Pat. No. 3,615,789 and others. Colloidal metals are usually so finely divided that individual particles are difficult to resolve microsopically. When coated on a support, these layers produce a high density to actinic light. For some elements a black image is desirable. However, colloidal metals can be produced in a variety of colors and hues; and each will modify the image produced over-all in a certain way. A variety of other colloidal metals may be substituted for silver within the ambit of this invention. Additionally, one may substitute exposed and developed silver halide or other silver salts for colloidal silver. Under practical consideration, however, high covering power, low cost elements are preferred; since an object herein is to reduce total silver coating weight and hence costs. Thus, finely divided, gelatino, colloidal siler yields the desired high densities at a substantially lower coating weight.

A layer of photosensitive silver halide is coated on the non-photosensitive colorant layer described above. Any of the conventional silver halides may be used in this invention including silver bromide, silver coloride, silver iodide or mixtures of two or more of the halides. Conventional photographic binding agents may also be used. We prefer a gelatino silver halide element. The silver halide emulsion may be chemically or optically sensitized using any of the known conventional photographic sensitizing agents. We prefer a gelatino silver halide element. The silver halide emulsion may be chemically or optically sensitized using any of the known conventional sensitizers and sensitization techniques. Other adjuvants such as antifoggants, hardeners, wetting agents and the like may also be incorporated in the emulsions useful with this invention.

The non-photosensitive, colorant layer or layers and the photosensitive, silver halide layer or layers are usually coated on a suitable photographic film support. Any of the conventional supports may be used within this invention. We prefer to use polyethylene terephthalate prepared and subbed according to the teachings of Alles U.S. Pat. No. 2,779,684, Example IV. These polyester films are particularly suitable because of their dimensional stability. Gelatin backing layers containing antistatic agents, or applied as anticurling layers may also be used. Preferably, we coat a thin, protective, gelatin anti-abrasion layer over the emulsion layer.

The silver halide emulsion layer can be applied at very low coating weights, since the density and contrast of the finished element is a direct result of the nonphotosensitive, colorant or opacifier layer. Thus, the combined element of this invention produces a high speed, direct positive, finished product with high contrast and superb image quality; since the final image results mainly from said colorant layer and thus the image is practically grainless. Advantageously within this system, the colorant or opacifier layer acts as an inherent antihalation layer, further sharpening the final image.

The elements of this invention are exposed in the manner for conventional silver halide products. For example, the element may be used in a camera and exposed through a lens system. Contact exposure to light through a suitable transparency may also be used. If the film is designed for radiographic purposes, an exposure to X-rays using fluorescent or lead screens, or by direct X-ray exposure, in the conventional manner is made. After exposure, the latent image present in the photosensitive silver halide layer is developed using any of the conventional developers containing any of the usual developing agents. We prefer adding water soluble compounds which will produce sulfide ions to said developer solutions. Thiourea, for example, performs this function adequately. Other compounds falling within the ambit of this invention include for following:

substituted thioureas
mono-or di-N-substituted thioacetamides
dialkyl substituted dithiocarbamates Developing is continued until a suitable image of developed silver is formed within the silver halide layer. The length of development is dependent on the type of developer used, temperature of development, nature of the emulsion, etc. After a suitable image has been developed, the element is preferably given a water rinse to remove excess developer from the film and immediately immersed in a chemical bleach bath designed to oxidatively bleach the nonphotosensitive, colorant layer. Many such baths are available dependent only upon the particular material used within the colorant layer. For colloidal silver layers, for example, aqueous potassium ferricyanide or cupric nitrate solutions containing halide ions are particularly efficacious. These bleach solutions may also contain oher adjuvants to adjust the pH, for example, or to aid in layer penetration by the oxidant.

Oxidation is allowed to occur until all the developed silver in the silver halide layer corresponding to the exposed portion of that stratum plus the colorant or opacifier beneath said exposed area is effectively removed. We prefer to add a conventional antifoggant (e.g. 1-phenyl-5-mercaptotetrazole) to said bleach bath in order to overcome the fogging tendency of the sulfide releasing compound.

After the bleach step, the element is preferably water washed and the remaining silver halide is removed by fixing in a conventional fixing batch (e.g. sodium thiosulfate solution. The final high quality, high density, high contrast image is preferably water washed to remove residual amounts of fixer. Alternatively, one may use any number of combined bleach-fix baths ("Blix").

It is thus possible to achieve excellent high density images from low coating weight silver halide elements. The image quality is usually better than the image quality achievable with an all silver halide system, since the colorant layer acts as an inherent antihalation layer in addition to the image forming layer. This novel system can be used in all types of imaging systems where silver halide is presently used and will achieve the same results described above. Thus, it is applicable to all positive working systems. One only needs to adjust the emulsion and balance the silver halide coating weight in relationship to the colorant used in order to achieve the desired results.

This inventin will now be illustrated by, but is not necessarily limited to, the following examples:

EXAMPLE 1

A sample of blue colloidal silver dispersed in gelatin was prepared according to the teachings of Firestine, German 1,234,031. This material was coated on a 0.004 inch (0.0102cm.) thick polyethylene terephthalate film base made according to Alles, U.S. Pat. No. 2,779,684, Example IV, and subbed on both sides with a layer of vinylidene chloriden alkyl acrylate/itaconic acid copolymer mixed with an alkyl acrylate polymer as described in Rawlins U.S. 3,443,950, and then coated on both sides with a thin anchoring substratum of gelatin (about 0.5 mg/dm$^2$). After drying, the film support containing the layer of colloidal silver had an optical density of about 2.16 to yellow light and had a coating weight of about 4 mg/dm$^2$ calculated as silver in about 13 mg/dm$^2$ gelatin to provide a silver covering power of about 540. A sample of this material was then overcoated with a high speed medical x-ray emulsion comprising about 98 mole percent silver bromide and about 2 mole percent siler iodide. The silver halide mean grain size was kept at about 1.5 to 1.8 micron by carefully controlling the variables of rate of addition of the silver nitrate to the ammoniacal halide solution and the ripening time and temperature. The silver halide was precipitated in a small amount of bone gelatin (about 20 g/1.5 mole of silver halide). It was later coagulated, washed and redispersed by vigorously stirring in water and additional gelatin (about 90 g/1.5 moles of silver halide) then added. After adjusting the pH to 6.5 ± 0.1, the emulsion was brought to its optimum sensitivity by digestion at a temperature of about 140° F (about 60° C) with gold and sulfur sensitizing agents. The usual wetting agents, coating aids, antifoggers, emulsion hardeners, etc. were then added. All these procedures, steps and adjuvants are well known to those skilled in the art of emulsion making and other adjuvants can be substituted with equivalent results. The emulsion was coated to a coating weight of about 23 mg. silver bromide/dm$^2$ (total coating weight of about 30 mg/dm$^2$ silver halide layer plus colloidal silver layer layer) and overcoated with a thin protective layer of hardened gelatin (about 10 mg/dm$^2$). A sample strip from this coating was exposed for 10 seconds through an 11 step 2 wedge (D=0 to 3.0) at a distance of about 2 feet (0.61 meters) from a G.E. 2A Photoflood lamp operating at 24 volts. This material was then developed at 76° F (about 25° C) for about 1½ minutes in a standard phenidone/hydroquinone X-ray developer containing additionally 0.2g/liter of thiourea and 1 ml/liter of 1-phenyl-5-mercaptotetrazole, 1g/100 ml. in alcohol. The strip was then water washed 15 seconds and oxidized 4 minutes in the following bleach bath:

| | |
|---|---|
| $Cu(NO_3)_2 . 3H_2O$ | 75.4g. |
| KBr | 4.0g. |
| Lactic Acid | 62.4ml. |
| $H_2O$ to | 1000ml. |

The film strip was then water washed for about 15 seconds, fixed in thiosulfate solution for about 300seconds, and dried. The result was a high quality, direct positive image with a resolution of about 60 l/mm.

EXAMPLE 2

A sample of film from that prepared in Example 1 was placed in a camera and exposed at ASA 400 speed (f/11 at 1/60th of a second) to an outdoor scene. This material was first processed for ½ minute in a conventional x-ray developer (phenidone/hydroquinone type) and for ½ minute in the developer of Example 1 (same developer but with thiourea and 1-phenyl-5-mercaptotetrazole). Other processing steps (wash-bleach-wash-fix-dry) were the same and total time (dry to dry) was abut 3 minutes. An excellent, positive transparency suitable for slide projection and enlargement was obtained.

EXAMPLE 3

A sample of colloidal palladium in gelatin was prepared following the procedures of Paul and Amberger, Berichte, 32, 124, (1904) using $PdCl_2$ instead of $Pd(NO_3)_2$ as the starting material. This material was coated on a sample strip of polyethylene terephthalate film using a 0.001 in. (0.00254 cm.) doctor knife. After drying, it was overcoated with an emulsion similar to that described in Nottorf, U.S. Pat. No. 3,142,568. This emulsion was an aqueous gelatin/ethyl acrylate bromochloride type containing about 30 mole percent AgBr and about 70 mole percent AgCl and brought to its optimum sensitivity with gold and sulfur sensitizing agents. The emulsion also contained the usual coating aids, antifoggers, hardeners, etc, as well as a typical merocyanine, orthochromatic sensitizing dye. The emulsion was coated to a coating weight of about 30 mg/dm² of silver bromide over the colloidal palladium layer. After dryingg, a sample of this coating was given a $10^{-3}$ second exposure on an Edgerton, Germeshausen and Greer (E.G. and G.) sensitometer through a 2 step wedge. The exposed film was given a 15 second development in a conventional X-ray developer followed by a 2 min. development in the developer of Example 1, then water washed 3 seconds and bleached for about 5½ minutes in conc. $HNO_3$ diluted 1:1 with water. A good positive image appeared in the colloidal palladium layer.

EXAMPLE 4

Copper was vacuum deposited at $8\times 10^{-5}$ torr on a 0.0042 inch thick (0.0107 cm.) polyethylene terephthalate film base using a Denton High Vacuum Evaporator Model DV502. The thickness of this material was between 0.00006 in. and 0.00012 in. (0.0015 cm and 0.00031 cm.) and had an optical density between 1.4 and 1.7. The film containing the vacuum deposited copper layer was coated with emulsion similar to that described in Example 3 to a coating weight of about 31.4 mg/dm² as silver bromide. A sample of the dried material was then given a 15 second exposure through a 2 step wedge at a distance of 2 ft. (0.610 meters) to a G.E. Photoflood lamp (300 watts) operating at 20 volts. This exposed material was developed 5 min. in a conventional X-ray developer (metol/hydroquinone) followed by 30 seconds in the same developer, but containing 5 ml. of a solution of 1-phenyl-5-mercaptotetrazole (1 g./100 ml. in alcohol) and 15 ml. of a solution of thiourea (1 g./100 ml. in alcohol) per 250 ml. of developer. This material was then washed and bleached for 45 seconds in the following solution:

| | |
|---|---|
| $K_2Cr_2O_7$ | 9.6 g. |

-continued

| | |
|---|---|
| $H_2SO_4$ (conc.) | 10.7 ml. |
| $H_2O$ to | 1 liter |
| Diluted 1:4 with water | |

The film strip was then was water washed, fixed 30 seconds in thiosulfate, washed and dried. A direct positive image of the step wedge was observed in the copper layer.

EXAMPLE 5

In a manner similar to that described in Example 4, zinc was deposited on resin subbed polyethylene terephthalate film to give a thickness of about 0.004 in (0.00102 cm.). This material was then coated with the emulsion of Example 4 to give a coating weight of about 47.5 mg/dm² as silver bromide. This material was exposed as described in Example 4, developed 10 seconds in standard X-ray developer (metol/hydroquinone) and 50 seconds in 250 ml. of the same developer containing 5 ml. of 1-phenyl-5-mercaptotetrazole and 15 ml. of thiourea (solutions from Example 4). This material was then washed in water and bleached 1 minute 55 seconds in the bleach from Example 4 fixed, washed and dried. A good quality, direct positive image in the zinc underlayer with $D_{min.}=0.24$ and $D_{max}=1.10$ was observed.

EXAMPLE 6

In a like manner, lead was vacuum deposited to yield a thickness of about 0.0003 in. (0.00076 cm.) and overcoated with the emulsion of Example 4 to a coating weight of about 28.5 mg. silver bromide/dm². This material was exposed as described in Example 4, developed for 5 seconds in a conventional X-ray developer diluted 1:3 with water, then developed for 60 seconds in the same developer additionally containing 1 ml. of a thiourea solution (1g. thiourea/100 ml. water) and 3 ml. of 1-phenyl-5-mercaptotetrazole solution (1g./100 ml. alcohol) per 100 ml. of developer. The film was then washed, bleached in the solution of Example 4 for 2½ minutes, washed, fixed in a thiocyanate fixer for 30 seconds (50g. KSCN and 10g. $KAl(SO_4)_2$ 0.12 $H_2O$ in 1 l. water), washed and dried. A direct positive image with a $D_{min.}$ of 1 and a $D_{max}$ of 2 was observed in the lead underlayer.

EXAMPLE 7

In a similar manner, silver was vacuum deposited to yield a thickness of about 0.0004 in. (0.00102 cm.) and overcoated with the emulsion from Example 4 (diluted – 20 g. emulsion, 2.5 g. gelatin, 50 ml. $H_2O$) to a coating weight of about 28 mg/dm² as silver bromide. A sample strip of this coating was exposed as described in Example 4, developed 15 seconds in the developer of Example 6, water washed, and developed 45 seconds in the same developer containing 9 ml. of thiourea solution (1 g./100 ml. alcohol and 3 ml. of 1-phenyl-5-mercaptotetrazole solution (1 g./100 ml. alcohol) per 100 ml. of developer plus 100 ml. $H_2O$. The sample was then water washed, bleached for 2½ minutes in the bleach solution of Example 4, water washed, fixed 30 seconds in thiosulfate, water washed and dried. An excellent, direct positive image was obtained in the vacuum deposited silver layer. This image had a $D_{min}$ of about 1 and a $D_{max}$ of about 3.26.

EXAMPLE 8

A sample of colloidal copper was made in gelatin following the procedures of Paal and Steger, *Kolloid. Zeit.*, 30, 88 (1922). The reaction and subsequent handling procedures as described herein were carried out under a nitrogen atmosphere to prevent the formation of cuprous oxide. A portion of the colloidal copper was coated on a 0.007 inch (0.0178 cm.) thick, subbed polyethylene terephthalate film support using a 0.005 inch (0.0127 cm.) doctor knife. An emulsion similar to that described in Example 3 was coated on the dried colloidal copper layer to a coating weight of about 30 mg/dm² of silver bromide. This material was then dried and given a 15 second exposure through a 2 step wedge at a distance of 2 ft. (0.61 meters) to a G.E. Photoflood lamp (300 watts) operating at 20 volts. The exposed sample was then developed 10 seconds in a conventional X-ray developer (metol/hydroquinone) followed by 30 seconds in the same developer additionally containing 10 ml. of a thiourea solution (1 g./100 ml. $H_2O$) and 1 ml. of a solution of 1-phenyl-5-mercaptotetrazole (1 g./100 ml. in alcohol) per 100 ml. of developer solution. The strip was then water washed 15 seconds and bleached 15 seconds in the following solutions:

| | |
|---|---|
| Potassium dichromate | 10 g. |
| $H_2SO_4$ (conc.) | 10.7 ml. |
| $H_2O$ | to 1000 ml. |

The strip was then washed 30 seconds, fixed in standard thiosulfate fixer for 1 min., washed 2 minutes and dried. A direct positive image with a $D_{min}$ of 0.33 and a $D_{max}$ of 1.08 was obtained.

EXAMPLE 9

A sample of colloidal mercury was prepared according to the procedures of Sauer and Steiner, Kolloid. Zeit., 73, 42 (1935). This material was coated on subbed polyethylene terephthalate as described in Example 8, and overcoated with a gelatin layer of about 0.005 in. (0.0127 cm.) thickness. The emulsion of Example 8 was coated over this gelatin layer to a coating weight of about 30 mg/dm² of silver bromide. This sample was then given a 15 second exposure through a 2 step wedge at a distance of 2 ft. (0.61 meters) to a 300 watt G.E. Photoflood lamp operating at 30 volts. The exposed sample was then developed 15 seconds in a standard X-ray developer (metol/hydroquinone) followed by developing 60 seconds in the same developer composition additionally containing 2 ml. of a thiourea solution (1 g./100 ml. of water) and 1 ml. of 1-phenyl5-mercaptotetrazole solution (1 g./100 ml. of alcohol) per 100 ml. of developer solution. The sample was then water washed 15 seconds, and bleached 3 minutes in the following solution:

6 g. $KMnO_4$
10 ml. $H_2SO_4$ (conc.)
Diluted to 1 l. with $H_2O$

The sample was washed 30 seconds, fixed in standard fixer for 1 min., washed 2 minutes and dried. A direct positive image with a $D_{min}$ of 1.16 and a $D_{max}$ of 2.35 was obtained in the colloidal mercury layer.

EXAMPLE 10

A sample of film support having the emulsion of Example 3 coated thereon was exposed to room lights for 2 minutes, developed in standard X-ray developer for 30 seconds, placed in an acid stop bath for 30 seconds, fixed, washed and dried. This yielded a fogged emulsion layer. Another layer of emulsion (about 20 mg. AgBr/dm²) was overcoated thereon and exposed $10^{-3}$ seconds through a 2 step wedge on an E.G. and G. Sensitometer (see Example 3). This exposed sample was developed 5 seconds in the standard developer (see above) and 1½ min. in the same developer solution additionally containing 0.9 g./l. of thiourea and 0.3 g./l. of 1-phenyl-5-mercaptotetrazole (added as a solution of 1 g./100 ml. in alcohol). The developed sample was water washed 15 seconds and oxidized 5 minutes in the bleach bath of Example 1 followed by a 15 second water wash and 1 min. in standard thiosulfate fixer. The washed and dried image was a good clear direct positive image in the fogged under layer with a $D_{min}$ of 0.10 and a $D_{max}$ of 0.66.

EXAMPLE 11

A film support containing the blue colloidal layer of Example 1 was overcoated with an emulsion layer similar to that described in Example 3 to a coating weight of about 52 mg. AgBr/dm² After drying, sample strips from this coating was given a $10^{-2}$ second exposure on the E.G. and G. sensitometer through a 2 step wedge. All three samples were developed 1½ minutes in a standard lith developer (hydroquinone-sodium formaldehyde-bisulfite type) followed by developing 30 seconds in the developer of Example 1 containing additionally varying amounts tetramethylthiourea (TMTU). Each sample was then water washed 30 seconds and bleached 1½ minutes in the following bleach bath:

| | |
|---|---|
| $CuSO_4 . 5H_2O$ | 18.8 g. |
| KBr | 17.8 g. |
| $H_2O$ to | 50 ml. |

Each sample was then fixed 1 minute in thiosulfate, water washed 1 minute and dried. All of the above processing steps were carried out at room temperature. Direct positive images having the following sensitometric properties were obtained:

| Sample | Amt. of TMTU g./l. of Developer | $D_{max}$ | $D_{min}$ |
|---|---|---|---|
| 1 | 5 | 4.41 | 0.09 |
| 2 | 10 | 4.33 | 0.20 |
| 3 | 15 | 4.23 | 0.21 |

EXAMPLE 12

A film sample from Example 11 was exposed as described therein and processed as follows (at room temperature):

Develop 1½ minutes in litho developer (see Example 11).
Develop by dipping 30 seconds in the developer of Example 1 containing 12.5 g./liter of dimethylthioacetamide (no agitation).
Water wash 30 seconds.
Bleach 70 seconds in the bleach bath of Ex. 11.
Fix in thiosulfate 1 minute.
Water wash 30 seconds.

Dry.

A direct positive image with the following sensitometry was obtained:

| $D_{max}$ | $D_{min}$ | Gamma |
|---|---|---|
| 5.34 | 0.04 | 12.4 |

EXAMPLE 13

A film sample from Example 11 was exposed as described therein and processed as follows (at room temperature):

Develop 1½ min. in litho developer (see Example 11).

Develop 30 seconds by dipping in the developer of Example 1, containing 9 g./liter of dimethyldithiocarbamate (with agitation).

Water was 30 seconds.

Bleach 1½ min. in the bleach bath of Example 11.

Fix in thiosulfate 1 minute.

Water wash 30 seconds.

Dry

A direct positive image with the following sensitometry was obtained:

| $D_{max}$ | $D_{min}$ | Gamma |
|---|---|---|
| 5.46 | 0.05 | 7.2 |

The novel elements of this invention can be used in any system which employs silver halide as the photosensitive element. Any colorant or opacifier bleachable in accordance with the image formed in the silver halide can be used in this invention. One need only select the proper bleach or oxidant necessary to remove the particular colorant layer used.

In place of gelatin, other natural or synthetic water-permeable, organic, colloid binding agents can be used. Such agents include water permeable or water soluble polyvinyl alcohol and its derivatives, e.g., partially hydrolyzed polyvinyl acetates, polyvinyl ethers, and acetals containing a large number of extralinear —$CH_2$-CHOH— groups; hydrolyzed interpolymers of vinyl acetate and unsaturated addition polymerizable compounds such as maleic anhydride, acrylic and methacrylic acid ethyl ester, and styrene. Suitable colloids of the last mentioned type are disclosed in the U.S. Pat. Nos. 2,276,322, 2,276,323 and 2,347,811. The useful polyvinyl acetals include polyvinyl acetaldehyde acetal, polyvinyl butyraldehyde acetal and polyvinyl sodium o-sulfobenzaldehyde acetal. Other useful colloid binding agents include the poly-N-vinyllactams of Bolton U.S. Pat. No. 2,495,918 the hydrophilic copolymers of N-acrylamido alkyl betaines described in Shacklett U.S. Pat. No. 2,833,650 and hydrophilic cellulose ethers and esters.

The emulsions can contain known antifoggants, e.g. 5-nitrobenzimidazole, benzotriazole, tetrazaindenes, etc., as well as the usual hardeners, i.e., chrome alum, formaldehyde, dimethylol urea, mucochloric acid, etc. Other emulsion adjuvants that may be added comprise matting agents, plasticizers, toners, optical brightening agents, surfactants, image color modifiers, etc. The elements may also contain antihalation and antistatic layers in association with the layer or layers of this invention.

The film support for the emulsion layers used in the novel process may be any suitable transparent plastic. For example, the cellulosic supports, e.g. cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. The film formed from the polyesterification product of a dicarboxylic acid and a dihydric alcohol made according to the teachings of Alles, U.S. Pat. No. 2,779,684 and the patents referred to in the specification of that patent is preferred. Other suitable supports are the polyethylene terephthalate/isophthalates of British Pat. No. 766,290 and Canadian Pat. No. 562,672 and those obtainable by condensing terephthalic acid and dimethyl terephthalate with propylene glycol, diethylene glycol, tetramethylene glycol or cyclohexane 1,4-dimethanol (hexahydro-p-xylene alcohol). The films of Bauer et al. U.S. Pat. No. 3,052,543 may also be used. The above polyester films are particularly suitable because of their dimensional stability. Still other supports include metal, paper, plastic coated paper, etc.

Sulfur sensitizers containing labile sulfur, e.g. allyl isothiocyanate, allyl diethyl thiourea, phenyl isothiocyanate and sodium thiosulfate; the polyoxyalkylene ethers in Blake et al U.S. Pat. No. 2,400,532, and the polyglycols disclosed in Blake et al. U.S. Pat. No. 2,423,549. Other non-optical sensitizers such as amines as taught by Staud et al., U.S. Pat. No. 1,925,508 and Chambers et al., U.S. Pat. No. 3,026,203 and metal salts as taught by Baldsiefen U.S Pat. No. 2,540,086 may also be used.

The invention may be further characterized as set forth in the claims that follow. In addition, preferred materials for use in the invention are disclosed in application PD-1552, filed concurrently herewith, the disclosure of which is incorporated herein by reference.

I claim:

1. A process of forming an image in a photosensitive element that comprises a film support, a photosensitive silver halide layer, and an underlayer containing a chemically bleachable colorant selected from the group consisting of colloidal silver, colloidal mercury, colloidal palladium, colloidal copper, a copper film, a zinc film, a lead film, and a silver film; which process comprises:

1. imagewise exposing said photosensitive silver halide layer to actinic radiation,
2 developing the resulting latent image in said silver halide layer,
3. no sooner than step (2), treating said photosensitive element with a compound capable of generating sulfide ions under the conditions of treatment said compound selected from the group consisting of thiourea, substituted thioureas, mono-or di-N-substituted thioacetamides, dialkyl substituted dithiocarbamates, and
4. immersing said photosensitive element in a chemical bleach bath so as to chemically bleach the image in the silver halide layer and to bleach those areas of the colorant-containing layer which are under the image in the silver halide layer, leaving an image in those areas of the colorant-containing layer which are directly under the unexposed non-image areas of the silver halide layer.

2. The process of claim 1 containing the additional step, not sooner than the step of chemically bleaching, of removing the bleached areas of said colorant-containing layer.

3. The process of claim 1 wherein said chemically bleachable colorant is a silver film deposited on the support.

4. The process of claim 1 wherein said colorant is colloidal silver.

5. The process of claim 4 wherein said compound capable of generating sulfide ions is thiourea.

6. The process of claim 4 wherein said bleach is an oxidizing bleach selected from potassium ferricyanide and cupric nitrate.

7. The process of claim 11 wherein said photosensitive silver halide layer is exposed through a half-tone screen.

8. A process of forming an image in a photosensitive element that comprises a clear polyester film support, a layer containing colloidal silver, and a photosensitive silver halide layer, which process comprises:

1. imagewise exposing said photosensitive silver halide layer to actinic radiation,
2. developing the resulting latent image in said silver halide layer,
3. treating said photosensitive element with thiourea, and
4. immersing said photosensitive element in a chemical bleach bath so as to chemically bleach the image in the silver halide layer and to bleach those areas of the colloidal silver-containing layer which are under the image in the silver halide layer, leaving an image in those areas of the colloidal silver-containing layer which are directly under the unexposed nonimage areas of the silver halide layer,
5. fixing the aforesaid image in the colloidal silver-containing layer by removal of the undeveloped silver halide and any bleach-generated silver salt, leaving a high density direct positive remaining on the support.

* * * * *

UNITED STATES PATENT OFFICE

CERTIFICATE OF CORRECTION

PATENT NO. : 4,029,509

DATED : June 14, 1977

INVENTOR(S) : Ralph Kingsley Blake

It is certified that error appears in the above-identified patent and that said Letters Patent are hereby corrected as shown below:

| Patent Column | Line | Correction |
|---|---|---|
| 13 | 15 | Claim 7, line 1: "11" should be -- 1 --. |

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*